United States Patent [19]

Jäger et al.

[11] 4,384,560

[45] May 24, 1983

[54] FUEL INJECTION SYSTEM FOR DIESEL ENGINES, IN PARTICULAR FOR DIESEL MOTOR VEHICLE ENGINES

[75] Inventors: Erich Jäger, Korb; Werner Faupel; Heinz Kuschmierz, both of Gerlingen, all of Fed. Rep. of Germany

[73] Assignee: Robert Bosch GmbH, Stuttgart, Fed. Rep. of Germany

[21] Appl. No.: 104,212

[22] Filed: Dec. 17, 1979

[30] Foreign Application Priority Data

Dec. 16, 1978 [DE] Fed. Rep. of Germany ..... 2854422

[51] Int. Cl.[3] ..... F02D 1/06; F02M 59/34

[52] U.S. Cl. ..... 123/383; 123/387; 123/501

[58] Field of Search ..... 123/382, 383, 387, 391, 123/500, 501, 502

[56] References Cited

U.S. PATENT DOCUMENTS

| | | | |
|---|---|---|---|
| 3,726,263 | 4/1973 | Kemp | 123/383 |
| 3,742,925 | 7/1973 | Gordon | 123/501 |
| 3,795,233 | 3/1974 | Crews | 123/387 |
| 4,197,059 | 4/1980 | Simko | 123/501 |
| 4,273,090 | 6/1981 | Höfer | 123/502 |

*Primary Examiner*—Charles J. Myhre
*Assistant Examiner*—Carl Stuart Miller
*Attorney, Agent, or Firm*—Edwin E. Greigg

[57] ABSTRACT

A fuel injection system is proposed for Diesel type internal combustion engines, by means of which the ignition conditions of a Diesel engine are kept optimal even during operation at high altitudes despite a reduced air charge. The system includes a fuel injection pump equipped with an injection timing adjustment apparatus which functions in accordance with rpm and a control apparatus functions in accordance with the air quantity supplied to the engine. By means of the control apparatus, a correction controlled in accordance with air pressure and therefore dependent on air quantity is superimposed on the change in the onset of the fuel supply controlled by the injection adjuster at least in accordance with rpm. When a hydraulic injection adjuster is used, the supply pressure of a control pump is increased by a correcting final control element of the control apparatus when the air quantity is decreasing in the direction toward an early adjustment of the onset of supply.

3 Claims, 2 Drawing Figures

FUEL INJECTION SYSTEM FOR DIESEL ENGINES, IN PARTICULAR FOR DIESEL MOTOR VEHICLE ENGINES

BACKGROUND OF THE INVENTION

The invention is related to a fuel injection system of the type generally described herein and finally claimed. Fuel injection systems of this kind, intended in particular for Diesel motor vehicle engines, have an injection timing adjustment device functioning in accordance with rpm, which automatically compensates for the delay in injection onset at the injection nozzle which occurs at high rpm because of the long conduction paths. By the use of this injection timing adjustment device, which may also be called an automatic injection adjuster, the most favorable combustion and thus the maximum output of the Diesel engine are intended to be maintained even with widely variant rpm levels. However, it has been discovered that this is entirely true only when the air pressure conditions remain identical. For instance, if the Diesel engines are driven at high altitudes, then the capacity for ignition is restricted by the reduced air charge (lower final compression temperatures), and the ignition delay becomes larger, particularly at zero load and partial load. This causes both steep pressure gradients, and thus hard running on the part of the engine, and misfiring, which causes the emission of blue smoke.

A fuel injection system is already known having the general structure described with a fuel injection pump embodied as an injection pump of the distributor type (that is, with a distributor injection pump VE..F.. by Robert Bosch GmbH, Stuttgart, Germany; see, for example, the technical customer service manual VDT-I-460/1, second addendum of May, 1977 or the SAE Paper No. 760127 from the Automotive Engineering Congress in Detroit, Mich., held Feb. 23–27, 1976). In this pump, the position of a full-load stop of the rpm governor incorporated in the pump housing which determines the maximum permissible supply quantity is corrected in accordance with the charge pressure or the atmospheric pressure of the combustion air supplied to the engine. The hydraulic injection adjuster which functions in accordance with rpm and/or load does not, however, take into consideration the changed air pressure conditions that pertain to the combustion air, so that the disadvantages initially mentioned are not eliminated, despite the correction in supply quantity.

In a distributor injection pump known from the German Offenlegungsschrift No. 26 48 043, which has a hydraulic injection adjuster, a timing adjustment toward "early" is controlled in accordance with temperature and is superimposed on the injection adjustment controlled in accordance with rpm by means of a further change, controlled in accordance with temperature, in the presupply pump pressure exerted upon the adjustment piston of the injection adjuster. However, this timing adjustment toward "early" is effective only from the onset of starting until the warm-up of the engine. This apparatus is ineffective in the case of a warm engine, and the disadvantages mentioned above are not eliminated by this control apparatus either.

OBJECTS AND SUMMARY OF THE INVENTION

The fuel injection system in accordance with the invention has the advantage over the prior art in that because of the correction, controlled in accordance with air quantity, of the change in supply onset already controlled in accordance at least with rpm, ignition conditions are improved during operation of Diesel engines at high altitudes or when the air weight has been changed as a result of supercharging. The emission of hydrocarbons and thus of blue smoke is reduced under such conditions, and excessively hard running of the engine is prevented.

As a result of the characteristics disclosed, advantageous further embodiments and improvements of the fuel injection system disclosed are possible. Thus, it is particularly advantageous, in a fuel injection system having a hydraulic injection adjuster incorporated in the cam drive of the injection pump, which functions as the injection timing adjuster and actuated by the rpm-dependent supply pressure of a control pump, that the required correction dependent on air quantity can be attained in a simple manner by increasing the supply pressure of the control pump by means of a correcting final control element of the control apparatus when the air quantity is decreasing; the result is a shift forward (timing adjustment toward "early") of the onset of supply. In a fuel injection system in which the supply pressure of the control pump is controllable in accordance with rpm by means of a pressure control valve, the required correction is obtained in that the correcting final control element of the control apparatus engages the pressure control valve. If the fuel injection system is equipped with a throttle restriction, in addition to the pressure control valve, which influences the supply pressure of the control pump and thereby determines the outflow of a partial quantity, then the required correction can also be obtained without affecting the pressure control valve, in that the flow-through cross section of the throttle restriction is varied by means of the correcting final control element of the control apparatus.

A particularly advantageous and space-saving structure results, in a fuel injection system, in that the throttle restriction has a throttle cross section variable by means of the correcting final control element of the control apparatus and further in that the correcting final control element can be actuated by the final control element of the smoke-limiting apparatus which at the same time includes the control apparatus. Further simplifications of and improvements in this system are set forth herein. By means of the control apparatus integrated with the smoke-limiting apparatus, only a single final control element, which functions in accordance with air pressure, is necessary both for the adjustment of the full-load supply quantity to the air pressure of the combustion air fed to the engine and for the correction of the onset of supply, and both corrections are controlled in parallel. Because no additional final control element is required, the structural space required for an injection pump equipped solely with a smoke-limiting apparatus is sufficient for this apparatus as well.

The invention will be better understood and further objects and advantages thereof will become more apparent from the ensuing detailed description of exemplary embodiments taken in conjunction with the drawings.

DESCRIPTION OF THE EXEMPLARY EMBODIMENTS

Figure 1:
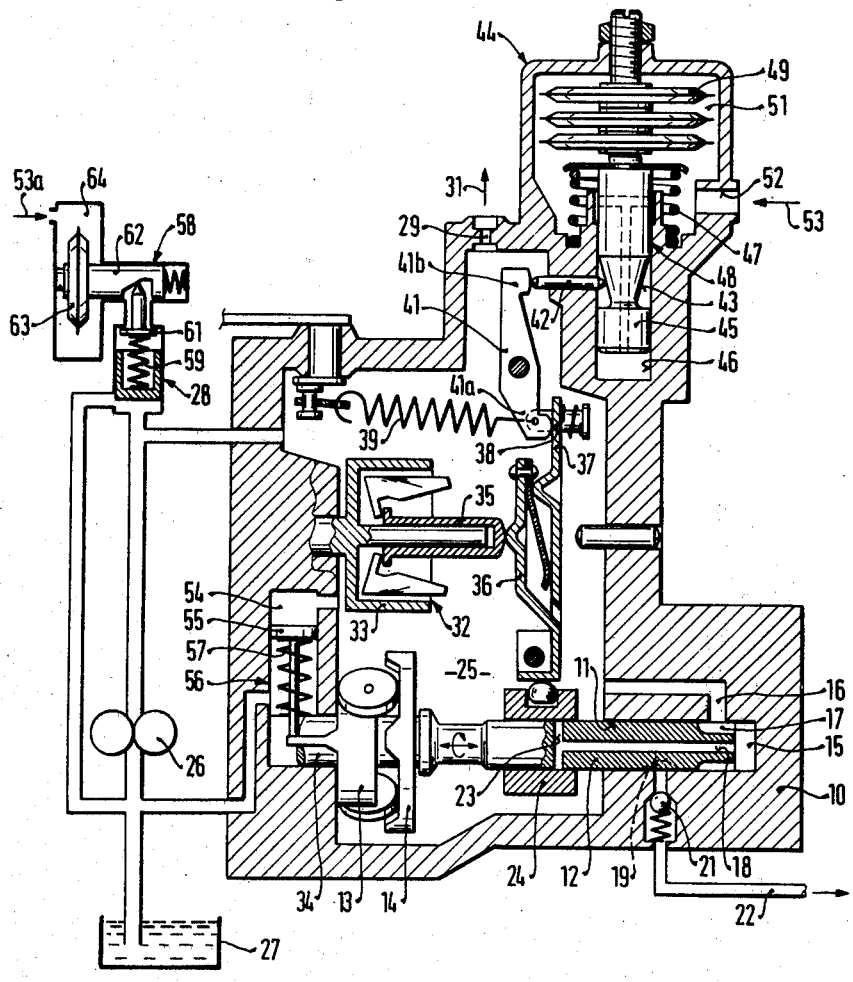
FIG. 1 is a simplified cross-sectional representation of the first exemplary embodiment, which is embodied as a distributor injection pump.

Turning now to the drawings, the first exemplary embodiment, shown greatly simplified in FIG. 1, is a lifting piston distributor injection pump of the type VE..F.. by Robert Bosch GmbH, Stuttgart, Germany, which is mass produced in great quantity and known from the documents cited above.

In a housing 10, a pump piston 12 moves within a cylinder bore 11. This piston 12 is set into simultaneously reciprocating and rotary motion, in a manner known per se, by a cam drive which comprises a roller ring 13 and a cam face plate 14. A pump work chamber 15 subject to the action of the pump piston 12 is filled during the suction stroke of the pump piston 12 via an intake bore 16 and control grooves 17 of the pump piston 12, and during the compression stroke of the pump piston 12, with the intake bore 16 closed, fuel is fed via a longitudinal bore 18 and a supply groove 19 which communicates therewith and further via a pressure valve 21 and a pressure line 22 to an injection nozzle, not further illustrated, at the engine cylinder. Upon the termination of fuel supply, a transverse bore 23 of the pump piston 12 which communicates with the longitudinal bore 18 is opened by an annular slide 24.

The fuel supplied to the pump work chamber 15 via the intake bore 16 is withdrawn from an interior chamber 25 of the injection pump which acts as the suction chamber; fuel directed by the annular slide 24 out of the transverse bore 23 can also flow back into this interior chamber 25. Fuel is fed from a supply container 27 to the interior chamber 25 by a control or presupply pump 26, the supply pressure of which is controlled in accordance with rpm by a pressure control valve 28. Parallel to the overflow quantity which returns via the pressure control valve 28 to the supply container 27, the interior chamber is provided, preferably at its highest point, with a throttle restriction which determines the continuous outflow of a partial quantity. A return flow line 31, indicated only by an arrow, is attached to the throttle restriction 29 and leads back (in a manner not further illustrated) to the supply container 27. The interior chamber 25 of the pump is cooled by means of this continuously escaping partial quantity. This cooling is necessary, because the interior chamber 25 houses not only the cam drive 13, 14 of the pump piston 12, but also a mechanical rpm governor 32 actuated by centrifugal force. A centrifugal force governor 33, which is set into rotary motion in a manner not further illustrated by a drive shaft 34 which also drives the cam face plate 14 of the cam drive, actuates the annular slide 24, which acts as the supply quantity adjustment member of the lifting piston distributor injection pump, in a known manner via a governor sleeve 35 and a control lever 36. The axial position of the annular slide 24 which is actuated by a pivotal lever 36 controls the termination of supply and thus the injection quantity of the pump. In the full-load position of the governor elements shown, the control lever 36 is in contact with a tensioning lever 37, the position of which is determined by the position of a full-load stop 38. The initial stressing force of a control spring 39 which holds the tensioning lever 37 in contact with the full-load stop 38 determines the breakaway speed.

The full-load stop 38 is formed by the spherical end of a lever arm **41*a* of a pivotally mounted two-armed stop lever 41, the second lever arm 41*b* of which is supported on a protrusion arranged on a pickup pin 42. The pickup pin 42 that is guided in an aperture in the wall of the pump housing 10 by means of a narrow slide fitting which prevents the passage of fuel, is supported in turn on a cam surface 43 of a smoke-limiting apparatus 44. The cam surface 43 is cut into the surface area of a control slide 45, which is guided in a bore 46 of the pump housing 10 with the control slide being actuatable, as part of an adjustment member 48 of the smoke-limiting apparatus 44, by a set of diaphragm boxes or bellows-like member 49 against the force of a restoring spring 47. The chamber 51 which surrounds the set 49 of diaphragm boxes is connected via a bore 52 to ambient air pressure or via a charge air line indicated by an arrow 53 to the intake manifold of the engine. As a result of the bellows construction, the smoke-limiting apparatus 44** functions in accordance with the absolute air pressure, and this apparatus can be used both for a correction of the full-load supply quantity in accordance with atmospheric pressure and for a correction in accordance with charge pressure.

The fuel which is under presupply pump pressure controlled in accordance with rpm and is delivered to the interior chamber 25 of the presupply pump 26 also, via a pressure chamber 54 attached to the interior chamber 25, actuates an adjustment piston 55 of a hydraulic injection adjuster 56 which functions as the injection timing adjustment apparatus. The adjustment piston 55 which operates counter to the force of a restoring spring 57 is articulated for this purpose on the roller ring 13, and it rotates the latter, when the presupply pump pressure in the interior chamber 25 is increasing, in the direction of a timing adjustment toward "early" for the onset of supply. The presupply pump 26 driven by the drive shaft 34, which is shown outside the pump housing 10 only for the sake of being more easily viewable, hereby serves as the control pump of the injection timing adjustment apparatus 56, and the associated pressure control valve 28 is, in practice, naturally also incorporated in the pump housing 10.

In order to obtain not only the correction in supply quantity controlled in accordance with air pressure by means of the smoke-limiting apparatus 44 but also a correction of the change in the onset of supply which is also controlled for engine operation in accordance with air pressure, the pressure in the interior chamber 25 of the pump controlled by the pressure control valve 28 is corrected by means of a control apparatus 58 in accordance with the air pressure of the combustion air fed to the engine. Accordingly, such an operation causes a shift toward "early" when the air pressure is dropping, and thus a pressure increase in the interior chamber 25. This takes place, in the exemplary embodiment shown in FIG. 1, by means of a change in the initial stressing of a pressure control spring 59 of the pressure control valve 28. To this end, the position of a spring support 61 for the pressure control spring 59 is variable by means of a correcting fluid control element 62 in accordance with the air pressure. The correcting final control element 62, similarly to the final control element 48 of the smoke-limiting apparatus 44, accordingly is provided with a set of diaphragm boxes 63, illustrated here for the sake of simplification by only a single diaphragm or bellows device. A chamber 64 which surrounds the diaphragm box set 63 thereby communicates either with ambient air pressure or, via a line indicated by an arrow 53*a*, with the intake line of the engine. This arrangement enables a correction of the onset of injection which is controllable entirely independently of the smoke-limiting apparatus 44. An adjustment by this control apparatus 58 that is arranged to have the same effect can also be made by influencing the discharge quantity of the pressure control valve 28 or by controlling a counterpressure which is effective on the side of the pressure control spring 59. However, in all the possible variants covered under the invention, the fuel pressure in the interior chamber 25 must undergo the pressure change required for correction in accordance with air quantity.

Figure 2:
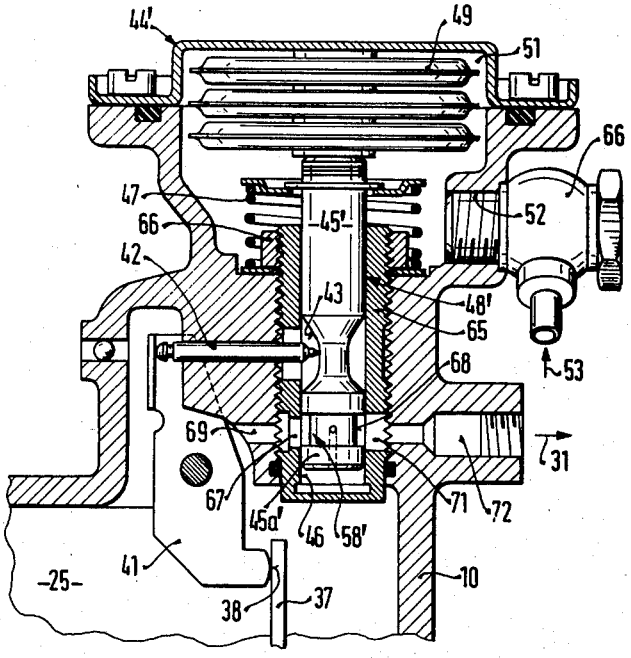
FIG. 2 is a cross-sectional view through the portion essential to the invention of the second exemplary embodiment, which is preferred because of its space-saving structure.

In the exemplary embodiment shown schematically in FIG. 2, elements which are the same as in FIG. 1 are given the same reference numerals, and elements which deviate therefrom are given numerals provided with a prime. A smoke-limiting apparatus 44′ is built onto the pump housing 10 and its set of diaphragm boxes 49 are combined with a control slide 45′ which operates counter to the force of the restoring spring 47 to make up a final control element 48′. The control slide 45′ is guided in a guide sleeve 65, which is threaded into the pump housing 10 and appropriately secured therein by means of an annular nut 66. The bore 46 in the guide sleeve 65 which includes the control slide 45′ is closed toward the interior chamber 25 of the injection pump, so that the presupply pump pressure which prevails in the interior chamber 25 cannot be exerted on the control slide 45′. The chamber 51 of the smoke-limiting apparatus 44′ which surrounds the set of diaphragm boxes 49 communicates with ambient air via a threaded element 66 inserted into the bore 52, so that this smoke-limiting apparatus 44′ acts as a full-load stop which functions in accordance with atmospheric pressure. Accordingly, the adjustment path controlled by the cam surface 43 and transmitted via the pickup pin 42 and the stop lever 41 onto the full-load stop 38 determines the position of the tensioning lever 37 and this in turn determines the full-load supply quantity of the injection pump. This tensioning lever 37 is the tensioning lever, shown in greater detail in FIG. 1, of the rpm governor 32. The threaded element 66 enables the delivery of the air, under atmospheric pressure, via the line 53 from the air filter or intake manifold of the engine, or, in the illustrated, shorter embodiment, it prevents the entry of dirt into the chamber 51. If the line 53 is connected to the intake manifold of a supercharged engine, then this apparatus can also function as a full-load stop dependent on charge air.

In this exemplary embodiment of FIG. 2, the smoke-limiting apparatus 44′ also contains the control apparatus 58′, and one part 45*a*′ of the control slide 45′ thereby acts as the correcting final control element of this control apparatus 58′ and is thus actuated by the same set of diaphragm boxes 49 which also controls the correction of supply quantity via the cam surface 43. The part 45*a*′ of the control slide 45′ is provided with an annular groove 68, which together with a throttle slit 67 that is provided in the wall of the guide sleeve 65 comprises the control apparatus 58′, with the effective throttle cross section dependent on the axial position of the annular groove 68, which is in turn controlled in accordance with air pressure by the diaphragm box 49. As a result of the throttle cross section of the throttle slit 67 controlled by the control slide 45′, the discharge of a partial quantity of the fuel, located in the interior chamber 25 at a pressure which is dependent on rpm, into the return flow line 31 which leads back into the supply container 27 is controlled in accordance with air quantity, so that the pressure controlled in accordance with rpm in the interior chamber undergoes a correction dependent on air quantity and the change in the onset of supply dependent on the presupply pressure in the interior chamber 25, is accordingly adapted to the air quantity by means of the injection timing adjuster. The stroke of the control slide 45′ is set to be such that the throttle slit 67 never can be entirely closed, so that a partial quantity of fuel, required for cooling the interior chamber 25, always escapes. The throttle slit 67, which functions as a variable throttle restriction, communicates via a bore 69 in the wall of the pump housing 10 with the interior chamber 25 and via the annular groove 68 on the control slide 45′, a bore 71 in the wall of the guide sleeve 65, a further bore 72 in the wall of the pump housing 10 with and finally the return flow line 31.

By means of the part of the smoke-limiting apparatus 44′ which contains the control apparatus 58′ and arranged to extend into the pump housing 10, the outer contour of the pump is not changed in comparison with that of a pump having a smoke-limiting apparatus functioning in accordance only with air pressure, because the function of the correction, dependent on air pressure, of the change in the onset of supply is undertaken as well in a simple manner by the final control element 48′.

The correction of the change in the onset of supply which is otherwise in accordance at least with rpm, controlled in accordance with air pressure and thus with air quantity as described above may be put to use in any other kind of injection timing adjustment apparatus as well, even those which are electrically controlled in open-loop or closed-loop fashion.

The foregoing relates to exemplary embodiments of the invention, it being understood that other embodiments and variants thereof are possible within the spirit and scope of the invention, the latter being defined by the appended claims.

What is claimed and desired to be secured by Letters Patent of the United States is:

1. In a fuel injection system for diesel internal combustion engines, including: a fuel injection pump having at least one pump piston; and an injection timing adjustment apparatus connected to the fuel injection pump for adjusting the onset of the fuel supplied by said at least one pump piston in accordance with at least the engine rpm as one operational parameter of the engine, the improvement comprising:

a cam drive for driving said at least one pump piston; and a control pump which supplies fuel with rpm-dependent pressure to the fuel injection pump, wherein said injection timing adjustment apparatus is hydraulic and is connected to said cam drive;

a control apparatus connected to the fuel injection pump and exposed to the pressure of the air quantity supplied to the engine for additionally adjusting the onset of the fuel supplied by said at least one pump piston, in accordance with the pressure of the air quantity supplied to the engine;

said control apparatus including a correcting final control element which increases the pressure of the fuel supplied to said fuel injection pump by said control pump, when an air quantity supplied to the engine is decreasing in the direction of a shift forward of the onset of the fuel supply toward "early";

means defining a throttle restriction through which a partial fuel quantity is discharged from the fuel injection pump thereby influencing the pressure produced by the control pump in addition to the influence exerted by the pressure control valve, wherein the flow-through cross section of the throttle restriction is variable by means of the correcting final control element;

a smoke limiting apparatus exposed to the pressure of the air quantity supplied to the engine; and a pressure control valve which is connected to the control pump and provides an rpm-dependent control of the pressure produced by the control pump, and wherein:

(1) the fuel injection pump is enbodied as a distributor injection pump including: a housing defining an interior chamber serving as the suction chamber of the fuel injection pump, into which fuel is supplied by the control pump; an rpm governor; a fuel supply quantity adjustment member; a full-load stop; and control lever means connected to the fuel supply quantity adjustment member, the rpm governor and the full-load stop, said full-load stop determining a limiting position of the control lever means and accordingly the maximum permissible full-load fuel supply quantity which the fuel injection pump delivers;

(2) the smoke limiting apparatus includes: the control apparatus; and control means which varies the position, and maintains in the various positions, the position of the full-load stop; and (3) the correcting final control element of the control apparatus is actuatable by the control means of the smoke limiting apparatus.

2. In the fuel injection system as defined in claim 1, wherein:

(4) the correcting final control element is embodied as a part of the control means of the smoke limiting apparatus.

3. In the fuel injection system as defined in claim 2, wherein:

(5) the control means of the smoke limiting apparatus includes: a guide sleeve; and a control slide displaceable within the guide sleeve;

(6) a portion of the control slide serves as the correcting final control element in which an annular groove is defined;

(7) the means defining a throttle restriction is formed as a slit cut within the wall of the guide sleeve;

(8) the portion of the control slide which serves as the correcting final control element, the annular groove and the slit cut within the wall of the guide sleeve comprise the control apparatus; and (9) the effective throttle cross section of the slit is variable by means of the axial position of the annular groove, said axial position being controlled in accordance with the pressure of the air quantity supplied to the engine.

* * * * *